United States Patent [19]

Merritt

[11] 4,240,153

[45] Dec. 16, 1980

[54] BIORHYTHM DISPLAY DEVICE

[76] Inventor: Raymond L. Merritt, 32 Lakeside Dr., Little Rock, Ark. 72204

[21] Appl. No.: 877,574

[22] Filed: Feb. 13, 1978

[51] Int. Cl.[3] ..... G04B 19/24; G04B 19/02; G06C 3/00; G09D 3/00

[52] U.S. Cl. ..... 368/28; 368/40; 368/220; 235/85 FC; 40/107

[58] Field of Search ..... 58/6 R, 6 A, 2, 125 C, 58/126; 235/70 A, 71 R, 78 RC, 85 FC, 86, 88 RC; 40/107 B; 74/216.5, 665 GE

[56] References Cited

U.S. PATENT DOCUMENTS

| | | | |
|---|---|---|---|
| 2,072,457 | 5/1933 | Larrabee | 58/125 C |
| 2,790,300 | 4/1957 | Lux | 58/6 A |

FOREIGN PATENT DOCUMENTS

| | | | |
|---|---|---|---|
| 530055 | 12/1972 | Switzerland | 40/107 B |

*Primary Examiner*—Vit W. Miska
*Attorney, Agent, or Firm*—Stephen D. Carver

[57] ABSTRACT

A device for continuously and automatically graphically displaying an individual's biorhythm functions. The device comprises a generally cubicle enclosure in which a plurality of endless loops are rotatably disposed. Separate, preferably translucent loops provided to indicate the physical, emotional, and intellectual biorhythm functions are marked with a sinusoidal waveform corresponding to the particular biorhythm function displayed. The loops over-lie each other throughout a substantial portion of their length to provide a composite graphical biorhythm display which is visible through an illuminated viewing area provided at the front of the device. An internal motor is provided to continuously drive suspension spools on which the loops are mounted. Gear linkage means operatively coupled between the motor and the spool includes synchronization means whereby the indicated biorhythm functions can be matched to the individual's corresponding biorhythm patterns, and the device can be set up properly on a given date for operation.

4 Claims, 11 Drawing Figures

BIORHYTHM DISPLAY DEVICE

BACKGROUND OF THE INVENTION

This invention relates generally to the measurement of human biorhythm cycles. More particularly, this invention relates to apparatus adapted to continuously and automatically provide a graphical display of an individual's human biorhythm funtions.

In recent years it has become increasingly well known in the scientific community that human beings periodically experience various cyclical physiological changes. The term "biorhythm" refers to the three repetitive human cycles known as the physical rhythm, the sensitivity rhythm and the intellectual rhythm or cycles. The latter cycles vary sinusoidally, but are of different "frequency" or "periods". All three cycles begin at the moment of the individual's birth.

The physical cycle is characterized by a 23 day physical rhythm. It has been stated that this cycle originates in the muscle cell or fibers in the human body. The first one half of the physical cycle is known as the ascendancy period in which a person may "feel" best, and in which his vitality and endurance are at their greatest. The second half of the physical cycle has been termed the "recharging period". It has been suggested that this half cycle is the best time for rest or decreased activities. The "critical" day in this cycle occurs at the half way point in the sinusoidal relationship. Critical days are those days in which a person may be less attentive or even accident prone.

The emotional or sensitivity cycle is characterized by a 28 day period. During the first half of the emotional cycle one may be inclined to feel optimistic or cheerful; but during the second 14 days of this cycle a person may feel "irritable" or "negative". The critical days in the sensitivity cycle occur on the first and fifteenth days of the rhythm.

The intellectual cycle lasts 33 days. It has been postulated that this cycle is rooted in the cells of the human brain. The first half of the intellectual cycle may be characterized by clear thinking, good memory function, and perhaps the most responsive concentration. The second half of the intellectual cycle, also of sixteen and one half days, is typically characterized by reduced concentration power, and mental tasks involving creativity or spontaneous thinking may become tougher or may seem more difficult than usual. The critical days occur at the first and seventeenth days of the cycle, during which time important decisions should not be made. As is appreciated by those skilled in this developing art, one's "best days" occur when all three biorhythm functions "peak" simultaneously. Conversely, one's "worst" days often coincide with simultaneous "dips" in the three presently known biorhythm functions.

In the prior art a variety of approaches to measurement and/or display of biorhythm relationships have been taken. Tables and/or graphs may be plotted, and the user may determine his present biorhythm graphically, "Plugging in" the parameters such as the present date and his birthdate. The latter approach is illustrated in a book entitled *Is This Your Day* by George S. Thommen, Crown Publishers, Inc., N.Y., which also provides a wealth of background material relevant to the instant subject.

Relevant prior art devices are shown in U.S. Pat. Nos. 3,852,949; 3,956,879; 3,152,437; and 3,217,486.

Bailey U.S. Pat. No. 3,956,879 shows the employment of a plurality of endless loops in a time cycle indicating device. Vasselli U.S. Pat. No. 3,152,437 depicts an apparatus including a plurality of time based rotatable gears for deriving and indicating the human female menstrual cycle. The most pertinent reference is believed to be Sayler U.S. Pat. No. 3,852,949 in which a plurality of individual loops comprised of spaced-apart colored beds or the like are employed to provide a visual indication of the user's present biorhythm state.

Another known prior art device for calculating personal biorhythm comprises a small, hand-held electronic calculator of solid state design, which has been programmed to provide a numeric biorhythm indication to the user, in response to commands inputted by the user. One such biorhythm calculator known to applicant is marketed by the Casio Company.

As mentioned earlier, the "critical" days in a given biorhythm cycle occur at definable times. Prior knowledge as to when such dates will occur can be of use in planning or scheduling one's activities. Known devices capable of indicating one's biorhythm do not provide a sufficient advance warning of critical dates without programming or manipulating the device in the manners used. Also, prior art devices have been inadequate in the means whereby the total cycles have been displayed. No known device provides a quick and convenient visual display of the three pertinent biorhythm functions, in a form in which the present and near-future biorhythm relationships may be viewed and all displayed simultaneously. Such an approach would be desirable as an aid for planning ones future itinerary. Also, no known prior art device of the type described provides a display of the biorhythm functions in the form of a conveniently visible composite image.

SUMMARY OF THE INVENTION

The invention preferably comprises a graphical biorhythm display device. The device is housed within a generally cubicle enclosure adapted to be disposed upon a supporting surface. Within the enclosure a plurality (preferably three) of endless, rotatable belts are suspended for rotation. Each of the belts corresponds to a particular biorhythm function. Thus, a first belt is provided for indicating an individual's physical biorhythm functions and second and third belts are provided for indicating the emotional and intellectual biorhythm functions respectively. Each belt is preferably comprised of translucent plastic material, and is marked with a preferably colored sinusoidal waveform. The belts are suspended within the enclosure through a rotatable spool system, and driven through drive spools operatively connected to an electric motor via a unique gear linkage system.

The preferably translucent belts closely over-lie one another throughout the front of the enclosure. In the preferred embodiment the viewing area may be illuminated by an internally located conventional light source. When the device is energized each of the three bands will continuously rotate and the sinusoidal biorhythm wave forms of the individual operator will be readily apparent from the front of the device.

Gear linkage means is provided to operatively couple the drive motor to the drive spools for rotating each of the belts. Importantly, gear synchronizing means are provided for individually setting each of the belts in accordance with the birth date of the user and the date at which the device is placed in operation. Thus gear linkage means is provided for independently manually rotating or adjusting each of the loops independently from one another. Gear adjustment means are also provided for simultaneously moving all three belts or loops in the event of a power failure or the like.

Thus an object of this invention is to derive and display an individual's biorhythm functions.

Another object of this invention is to provide a device of the character described which will provide a composite graphical biorhythm display.

Yet another object of this invention is to provide a biorhythm indication device in which the biorhythm functions are visually displayed.

Still another object of this invention is to provide a biorhythm calculating device which will operate continuously and automatically without further manipulation by the user after the device has once been programmed and placed in operation.

A still further object of this invention is to provide a biorhythm indicator device of the character described which may be conveniently and quickly programmed to fit the birth date of the user.

A related object of this invention is to provide a biorhythm indicator device which generates a composite, graphical biorhythm display.

These and other objects and advantages of this invention, along with features of novelty appurtenant thereto, will appear or become apparent in the course of the following description.

BRIEF DESCRIPTION OF THE DRAWINGS

In the following drawings, which form a part of the specification and are to be construed in conjunction therewith, and in which like reference numerals have been employed throughout to indicate like parts in the various views.

DETAILED DESCRIPTION OF THE DRAWINGS

Figure 1:
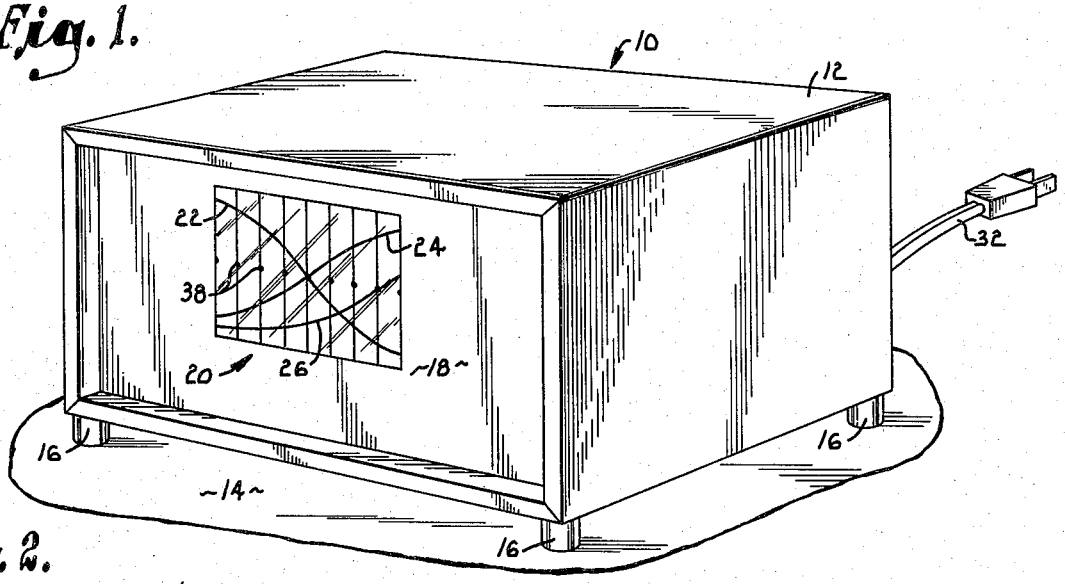
FIG. 1 is a perspective view of a graphical biorhythm display device constructed in accordance with the teachings of this invention.
Figure 2:
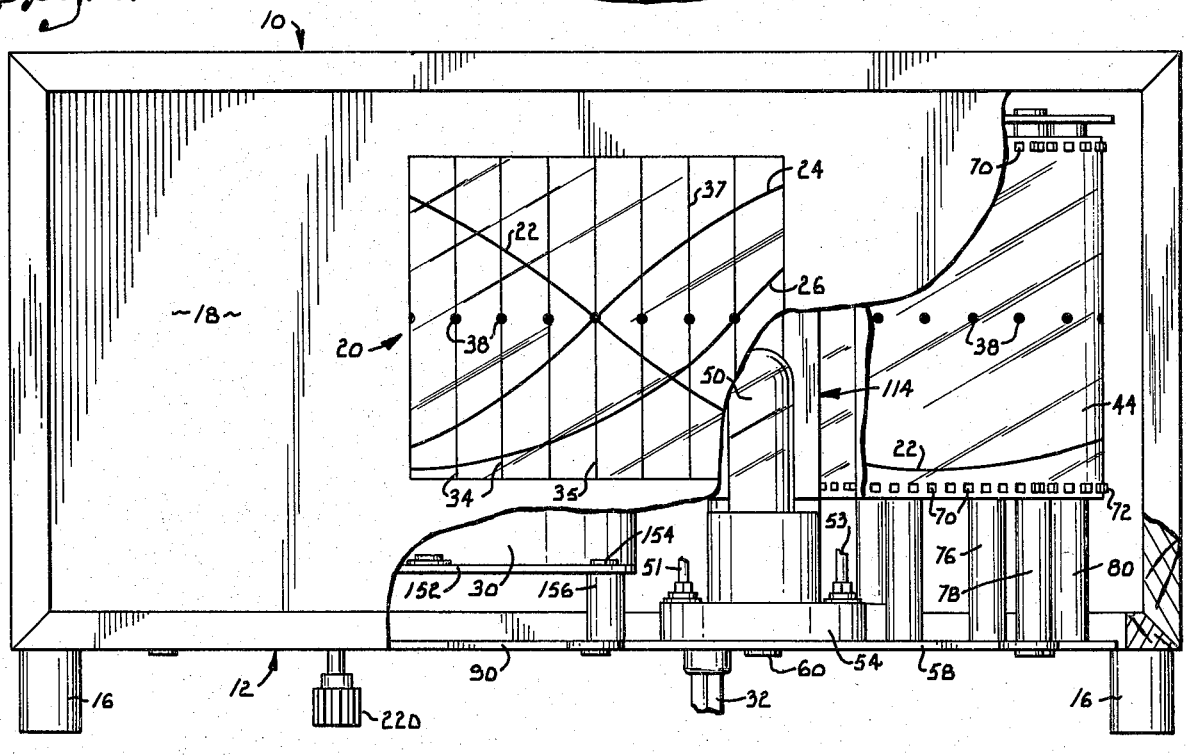
FIG. 2 is a front plan or view of the invention shown in FIG. 1 with parts thereof broken away or shown in section for clarity.

Referring initially to FIGS. 1 and 2 of the drawings, thereshown is a biorhythm calculating and display device 10 constructed in accordance with the teachings of this invention. The device 10 is preferably in the form of a generally cubicle enclosure 12 which is adapted to be disposed upon a supporting surface 14 via optional rubber or plastic feet 16. The front, preferably recessed panel 18 includes a viewing area 20 of generally rectangular dimensions in which a plurality (preferably three) of sinusoidal biorhythm functions are visibly displayed. Three visible sinusoidal patterns, 22, 24 and 26, respectively correspond to the intellectual, physical, and emotional or sensitivity cycles indicated by the device. As will be appreciated from discussion of the following figures, each of the traces 22, 24 and 26 is imprinted on a separate, substantially translucent, endless loop which is rotatably disposed within enclosure 12 and continuously rotated therewithin. Each of the endless loops include portions thereof which overlie each other within the viewing area 20 to provide a composite graphical biorhythm image. A preferably electric motor 30 provided within enclosure 12 drives each of the loops and may be powered by a conventional source of alternating current through an AC line 32 adapted to be plugged into a conventional nominally 120 v AC outlet.

With particular reference to FIG. 2, the viewing area 20 is marked with a plurality of vertically spaced-apart lines 34, 35, 37. In operation line 35 corresponds to the present day during which the unit 10 is in operation. Each of the loops (i.e., traces 22, 24 and 26) move from the right to the left (as viewed in FIG. 1 and 2). Thus, from an inspection of viewing area 20, it will be appreciated that the particular composite biorhythm graphical image now displayed by the device indicates that the individual's physical cycle 24 will be rising, the individual's intellectual cycle 22 will be continuing to drop, and the individual's emotional or sensitivity cycle indicated by graphical segment 26 will slowly be rising. Each of the loops are marked with indicia 38, which divide the sinusoidal traces into one-day segments. By counting segments 38, for example, past or projected biorhythm readings may be ascertained.

Since the viewing area 20 is divided into days through the marking lines 34 it will be apparent that by inspecting the graphical composite display the user of the device may predict his future biorhythm functions. For example, it should be appreciated that the graphical display in viewing area 20 moves from the right to the left (as viewed in FIGS. 1 and 2.) Therefore, graphical setment 24 may be read two days in the future simply by viewing its position upon vertical section line 37.

In the preferred embodiment each of the graphical segments will be color-coded to provide an easier correlation to the viewer. For example, it is contemplated in the preferred embodiment that the 23 day physical cycle be indicated in red; that the 28 day emotional or sensitivity cycle be indicated in green; and that the 33 day intellectual cycle be indicated by a blue graphical trace.

Referring now to FIGS. 2–4, 8–11, it will be observed that the invention incorporates three endless loops in the form of translucent belts 40, 42, and 44, which respectively correspond to the physical, emotional and intellectual cycles of the user. Thus, it will be observed that in the preferred embodiment of this invention the length dimension of the loops is related by a ratio of 23:28:33. This ratio results from the fact that with the preferred gear drive system 48 each of the spool drive gears rotates at the same speed. As will be appreciated by those skilled in the gear drive art, the loops could be of equal length if different drive gear speeds were appropriately included. In the preferred embodiment each loop (FIGS. 9–11) is marked with two complete sinusoidal cycles. This has been found optimum for readability of the composite image, since, for example, the slopes of the waveforms are more clearly visible. However, as will be appreciated by those skilled in the relevant art, the number of cycles marked on each tape or loop may be varied if gear ratios and/or motor speeds are appropriately modified.

Figure 3:
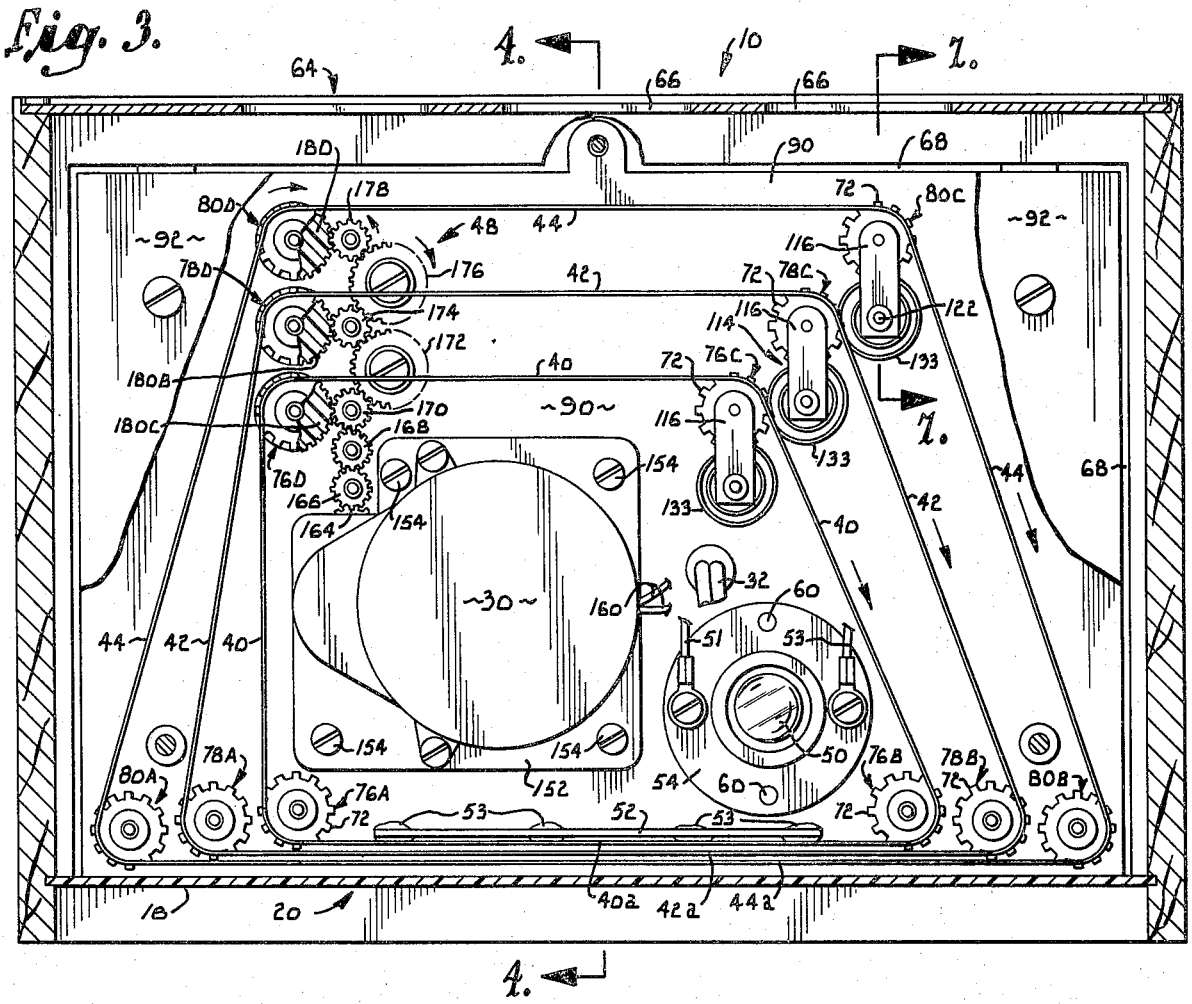
FIG. 3 is a sectional view of the invention taken internally within the enclosure along lines 3—3 of FIG. 2.

As best seen in FIG. 3 the belts comprise portions thereof 40A, 42A, and 44A, which closely lie adjacent to one another throughout a major portion of the length of each belt or loop immediate opposite the viewing area 20 to provide a composite biorhythm graphical display. Since the belts are substantially translucent, light projected from a light system 50 through a generally opaque, plastic or glass panel 52 will provide for illuminated viewing, light being distributed by panel 52. Panel 52 thus provides a back-lighting effect for illuminated viewing area 20. A lighting system 50 may be powered through conventional techniques, electricity entering through a pair of lines 51 and 53. The conventional light bulb 50 is received within a conventional socket 54 which may be fastened to the unit base 90 with screws 60 or the like.

Toward the rear 64 (as viewed in FIG. 3) of the unit a plurality of ventilation slots 66 may be provided to lower interior temperatures caused by heating effects of the light bulb 50. It will be noted that a gap 68 is provided between the case rear 64 and the lower base plate 70 to assist in air circulation within the unit.

Spool means are provided for suspending each of the belts for rotation within the device 10. As best viewed in FIGS. 9–11, each of the belts 40, 42, and 44 comprise a plurality of equally spaced-apart tracking notches 70 at the upper and lower portions of the belts for engagement within the cogged, flanged drive gear portions 72 provided at the upper and lower portions of each suspension spool 76, 78 or 80.

Thus, with particular reference to FIG. 3, belt 40 is suspended for rotation within enclosure 12 by spool means comprising four spools 76A, 76B, 76C, and 76D. Loop 42, which is marked with the 28 day sensitivity trace 26, is similarly suspended for rotation within the enclosure in surrounding relationship with respect to loop 40 by suspension spools 78A, 78B, 78C, and 78D. In a similar fashion the intellectual cycle loop 44 is suspended for rotation within the enclosure (and completely surrounds the other two loops 40 and 42) by a plurality of spools 80A, 80B, 80C, and 80D. Each of the belts are driven by drive spools 76D, 78D, or 80D, which include gear means linked to gear linkage system 48 for rotation by motor 30. Spools 76C, 78C and 80C "take up the slack" in the loops 40, 42 and 44 acting as followers to maintain the loop tension necessary for proper operation.

Figure 5:
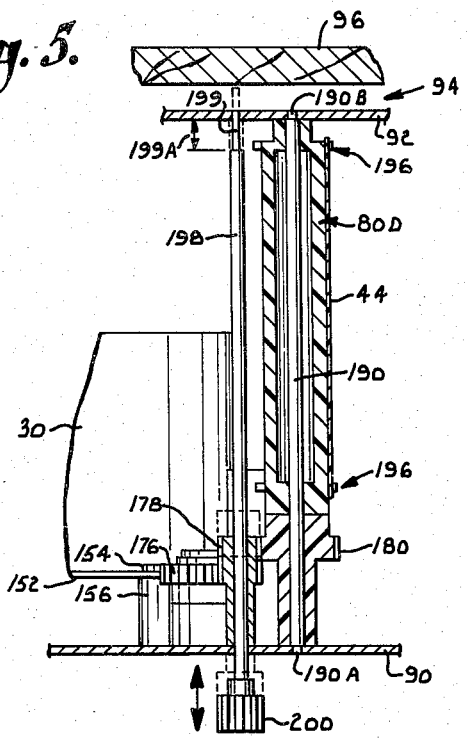
FIG. 5 is a sectional view of the master drive spools taken along line 5—5 of FIG. 4.
Figure 6:
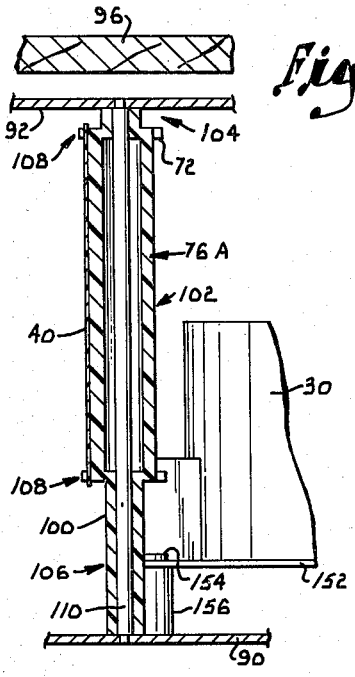
FIG. 6 is a view of the corner idler spools taken along line 6—6 of FIG. 4.

Referring additionally to FIGS. 5 through 8, each of the belt or loop suspension spools is oriented generally vertically perpendicular with respect to the plane of the enclosure interior, and extends for rotation between the lower preferably metallic base plate 90 and an upper preferably metallic planar plate 92. It will be observed that a ventilation air space 94 is preserved between the upper plate 92 and the enclosure 12. Suspension spools 76A, 76B, 78A, 78B, 80A and 80B (FIG. 3) are substantially similar in construction and function. Referring particularly to FIG. 6, spool 76A will be described in detail.

Spool 76A (as well as the previously mentioned similarly functioning spools) preferably comprises an elongated generally cylindrical body portion 100 which extends vertically between plate 90 and 92. The spool includes a central portion 102 of a diameter substantially greater than the upper and lower portions 104 and 106 thereof. Portion 102 is separated from portions 104 and 106 by somewhat larger diameter cog drive wheel portions 108, which include a plurality of circumferentially spaced-apart drive teeth 72 as previously discussed. A centrally, coaxially disposed, preferably metallic pin 110 passes through the spool and is journaled for rotation within place 90 and 92 allowing the spool to rotate freely. As will be appreciated from FIG. 6, each of the endless belts or loops (belt 40 in FIG. 6) is wound about larger diameter portion 102, and the guide notches 70 (FIGS. 9 through 11) are received and engaged within the drive cogs 72 so that the belts are prevented from slipping upwardly or downwardly (as viewed in FIG. 6) during operation of the device.

Figure 7:
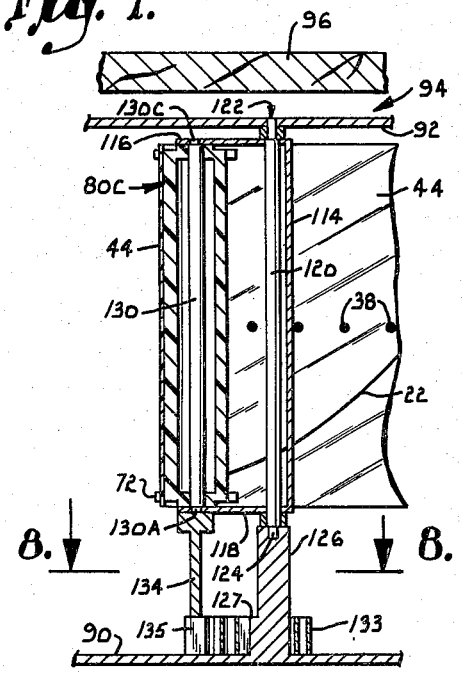
FIG. 7 is a view of a spring based idler spool utilized to tension the belts; taken along line 7—7 of FIG. 3.
Figure 8:
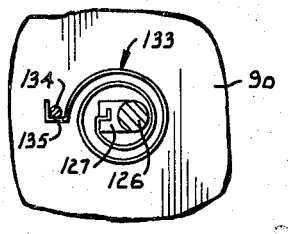
FIG. 8 is a sectional view of the tension spring preferably employed by the idler spools, taken along line 8—8 of FIG. 7.
Figure 9:
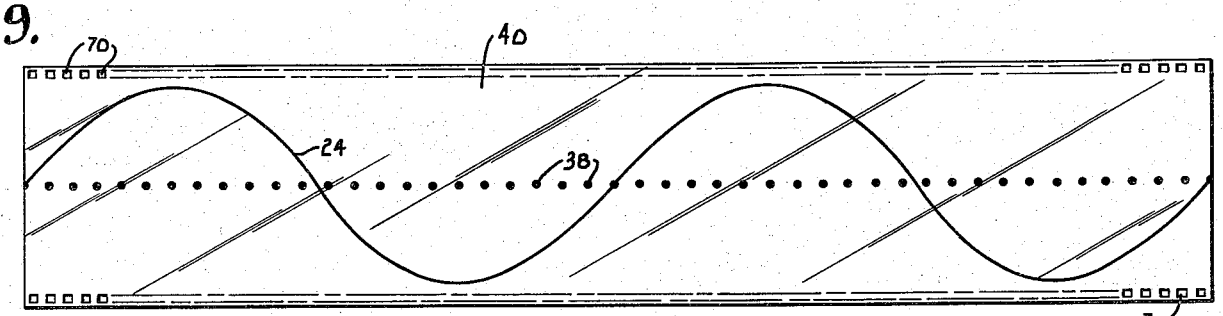
FIGS. 9–11 respectively show the belts corresponding to the physical, emotional, and intellectual cycles respectively.
Figure 10:
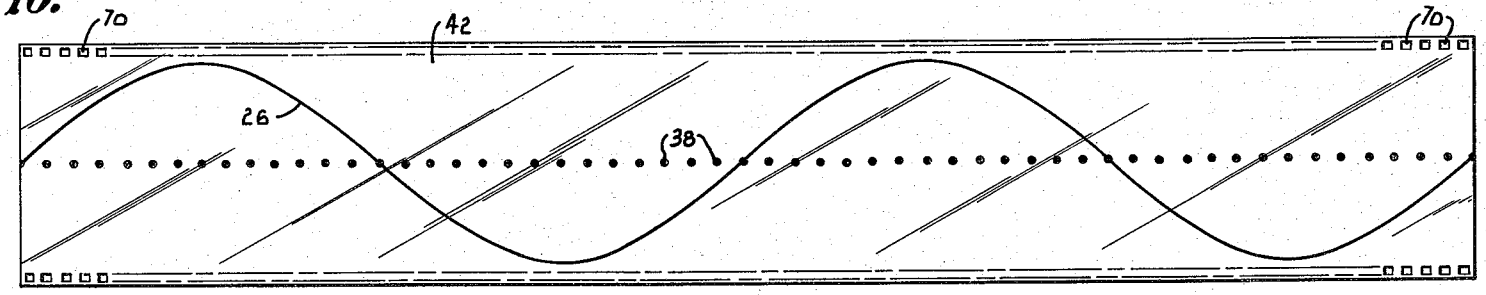
Figure 11:
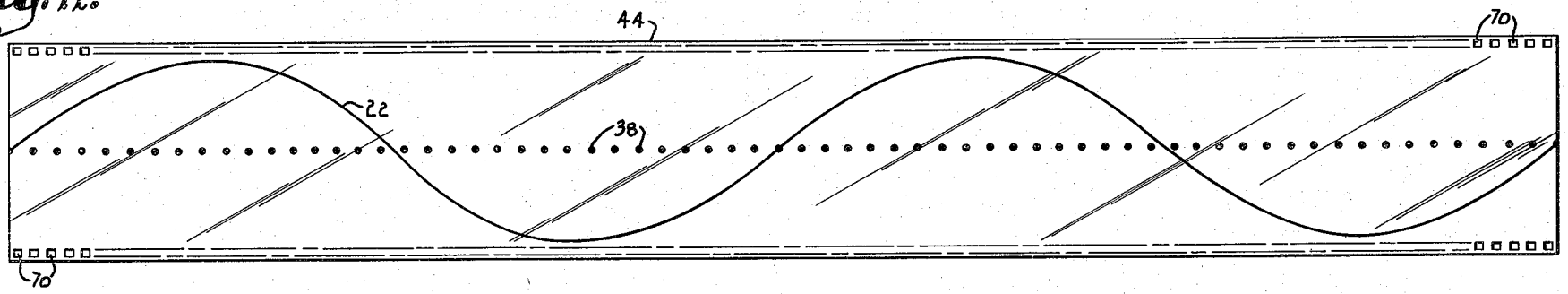

Spools 76C, 78C and 80C (FIGS. 3 and 7) tension the belts during operation. The latter spools are constructed substantially the same as spools 76A, 76B, etc. As best seen in FIG. 7 they are journaled for rotation between oppositely disposed, generally horizontal portions 116 and 118 of a generally C-shaped tortion mounting clamp 114. Thus, spool 80C, for example, is journaled for rotation in upper section 116 and lower section 118 of clamp 114, pin 130 extending through the spool for this purpose. A rotation rod 120, which extends through clamp 114, includes a smaller diameter portion 122 journaled for rotation in upper plate 92, and a lower, smaller diameter portion 124 which is journaled for rotation within a lower buss 126, which is rigidly affixed to the lower plate 90. The central pin 130 extending coaxially through spool 80C includes a lower diameter portion 130A which is journaled for rotation within clamp section 118, and an upper, smaller diameter portion 130C journaled for rotation in clamp section 116. A torsion spring 133 is tensioned between a downwardly extending pin member 134 and stationary buss 126 (about which it is radially wound) to bias spool 80C towards the right (as viewed in FIG. 3) to maintain proper belt tension. The torsion springs employed in conjunction with each spool 76C, 78C and 80C exerts radial force upon the corresponding clamp 114 to properly tension the various belts. It will be appreciated that the tensioning spring structure discussed is the same for each tension spool.

Referring now to FIGS. 2 through 5, the motor drive system of the present invention will be discussed in detail. Motor 30 includes an output drive gear 150 (FIG. 4) which preferably rotates at 1/48th round per hour (rph). The motor is preferably attached to a mounting plate 152 by a plurality of screws 154 which are received through offset sleeves 156 and anchored to lower plate 90 thereby offsetting the motor from the lower realm of the enclosure 12. AC power may be inputted to the motor through a pair of lines 160 in a conventional fashion. Rotary motion is transmitted from motor 30 through its output gear 150 and via a preferably ½ inch idler pinion 164 to a trio of intermeshed gears 166, 168 and 170. Gear 170 engages at a lower drive gear at the base of spool 76D (which will be discussed later in detail in conjunction with similar construction of spool 80D in FIG. 5) as well as a preferably ½ inch idler gear 172. Idler 172 transmits rotary motion to a gear 174 which similarly drives a gear at the base of drive spool 78D and is also coupled to a preferably ½ inch idler gear 176. The ½ inch idler gear 176 transmits motion through a gear 178 which in turn engages the lower gear section 180 (FIG. 5) of drive spool 80D. It should be understood that each of the drive spools 76D, 78D, and 80D all include lower drive gears, which are respectively driven by gears 170, 174 and 178. It will thus be apparent from an inspection of the gear train means shown in FIG. 3 that each of the drive spools will be driven to rotate the various endless loops 40, 42, and 44 through the viewing area 20 so that a continually changing, graphical composite biorhythm image will be displayed.

Figure 4:
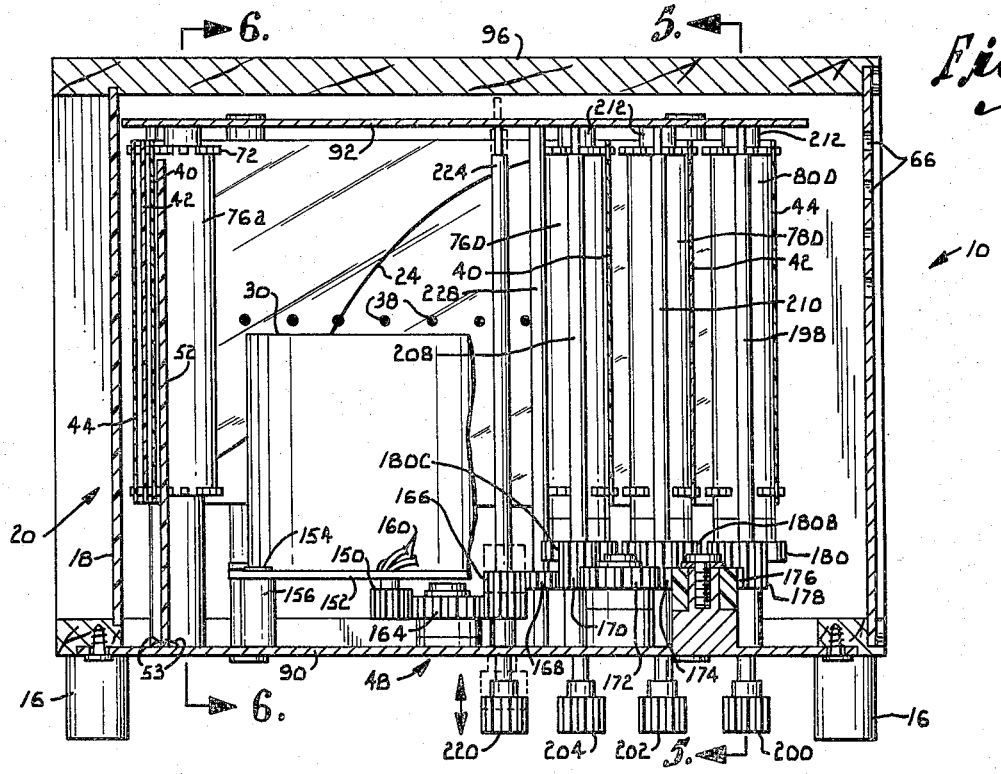
FIG. 4 is a sectional view of the gear drive chain system preferably employed by the invention, taken generally along lines 4—4 in FIG. 3.

Referring in particular now to FIG. 5 drive spool 80D is similar in construction to drive spools 76D and 78D. The drive spool is of generally elongated cylindrical construction, and includes an interior pin 190 which coaxially extends through the drive spool and includes smaller diameter portions 190A and 190B which are journaled for rotation in metallic plates 90 and 92 respectively. A somewhat larger diameter cogged portion 196 of the top and bottom of the drive spool includes the previously discussed gear cogs 72 which engage the tracking holes 70 provided in each of the loops to maintain the loops in proper engagement with the drive spool. Additionally, it will be apparent that at the lower portion of the drive spool a gear 180 is provided for engaging gear 178. Gear 178 is affixed to a coaxial rod member 198 which extends from beneath the lower base plate 90 and is journaled for rotation within upper plate 92. Beneath the lower plate 90 is a manually-actuable gear 200, which may be grasped to slip gear 178 into (or out of) engagement with gear 176. During normal operation of the device the gear 200 is positioned in a lowered position so that gear 178 is meshed between idler 176 and gear 180 thereby driving spool 80D. As indicated in dotted lines in FIG. 5, when gear 200 is pushed upwardly by the user, because of its longitudinally elongated shape it will become disengaged from idler 176, while remaining in engagement with drive spool drive gear 180. In this manner it will be apparent that spool 80D can be disengaged from the motor gear drive system and rotated alone so that by pushing up gear 200 and rotating same the endless belt 44 may be positioned appropriately for initially setting up the device for operation. It is important to note that drive spool 78D and 76D can similarly be removed from engagement with the motor and adjusted manually by the user. For example, a lower gear 202 (FIG. 4) may be manually pushed upwardly (as viewed in FIG. 4) in order to disengage gear 174 from idler gear 172, while at the same time remaining engaged with gear 180B, at the lower base portion of drive spool 78D. Thus, by pushing up gear 202, the user may manually reposition the setting of belt 42. Similarly, structure exists whereby gear 204 may be pushed up upwardly as viewed in FIG. 4 to move gear 170 out of engagement with idler 172 and gear 168 while at the same time remaining engaged with gear 180C, which is provided at the lower base portion of drive spool 76D for rotating same. Thus, in a similar fashion belt 40 may be adjusted in position by the user when the biorhythm device is being set up for initial operation.

Note that pin 198 (FIG. 5) includes an elongated, smaller diameter portion 199 which rotatably extends through plate 92. Shaft 198 may thus be moved axially a distance 199A, which must be at least ½ of the length of gear 178 to facilitate the aforementioned disengagement feature.

Adjusting gear 204 is linked to drive gear 170 via a rod 208 which is similarly journaled for rotation between plates 90 and 92. Similarly, adjustment gear 202 is linked and journaled for rotation via a rod 210. As best seen in FIG. 4, each of the drive spools 76D, 78D and 80D are preferably maintained in correct axial alignment by sleeve-like bearing structure 212 provided between the cogged loop drive gears and the upper plate 92.

All three drive spools are coupled to the motor via a gear 166 which may also be moved vertically upwardly out of position to disengage the drive spools from the motor. Referring to FIG. 4 it will be apparent that a lower, manually adjustable gear 220, which is linked to gear 166 through a vertically elongated rod 224, may urge gear 166 upwardly into the dotted line position illustrated in FIG. 4. When so urged upwardly, it will be apparent that gear 166 will be disengaged from idler 164, but since gear 166 is longitudinally approximately twice the length of gears 164 or 168, gear 168 will continue to be driven by rotation of gear 220. It will be apparent to those skilled in the art that the axle 228 upon which gear 168 is mounted in similarly journaled for rotation between upper and lower plates 90 and 92 respectively. However, the position of gear 168 relative to plate 90 is critical in that it must be positioned in such a way that gear 166 will remain engaged therewith when urged upwardly. In setting up the device 10, once all three individual loops are set to a particular biorhythm function, the particular date at which the device is set up may be adjusted by moving gear 220 upwardly and turning it by the user. It will be apparent from an inspection of the construction disclosed so far that gear 220 may thus manually control all three of the drive spools at once, so that for example, after the device 10 has been operating for a period of time, if a power failure is encountered, all three loops may be reset simply by counting the days by the front viewing screen and by setting the device appropriately with gear 220. During operation of the device, it will of course be apparent that all four manually adjustable gears 200, 202, 204 and 220, must be pulled downwardly into the operative position in order that the gear drive system remains completely engaged.

OPERATION AND SET-UP EXAMPLE

In order to initiate operation of the device 10, it is first necessary to calculate the biorhythm of the user by any of a variety of conventional methods. One method that will work is as follows: First, compute the number of days which have elapsed from the birthdate of the user. This number must then be divided by the length of each biorhythm cycle. As mentioned earlier, the length of the physical biorhythm section is 23 days; the length of the emotional or sensitivity biorhythm cycle is normally 28 days; and the length of the intellectual cycle is 33 days. The number of days elapsed since the user's birthdate must then be divided by these three numbers 23, 28 and 33. In each case the quotient is discarded since it represents elapsed cycles. The remainder from the division function is used to set up the device 10 as it represents the number of days into which the user is into each cycle. By way of example, the remainders of the various division functions discussed may be 15, 10 and 15. This would mean that the user is 15 days into the current physical cycle, ten days into the current sensitivity cycle, and 15 days into the current intellectual cycle. In order to set the device the four gears 200, 202, 204 and 220 may be adjusted. Preferably each band is color-coded. The 23 day physical cycle (trace 24, band 40) is set by gear 204. Similarly the 28 day emotional or sensitivity cycle is color-coded green (trace 26, band 42) and is adjusted by gear 202. The 33 day intellectual cycle (trace 22, band 44) is controlled by adjustment of gear 200. It will be observed from an inspection of FIGS. 9 through 11 that each band is marked with a plurality of spaced-apart dots 38 at a central portion thereof. The distance between each of the dots 38 is one day. Each cycle starts at the left of the display and the bands move towards the left (as viewed in FIGS. 1 or 2). First, one counts the number of days he is into each particular cycle. Second, the appropriate loop is moved by line 35, moving the start of the sinusoidal wave towards the left a given number of days. It perhaps may be more convenient to turn all three cycles until they are coordinated in that the sinusoids start at the same point. From the starting reference point so conceived each cycle may be advanced forward the number of days calculated by the division step mentioned earlier. The device is now set. However, if the current time is noon, for example, then the cycle should be set half way between the marks. The first knob, (220) may be used as desired by the user to advance or reverse the cycles without going through the setting procedure again. This may be advantageous, for example, to discern one's biorhythm at a given future or past date without interrupting the setting of the device. Moreover, in the event of a power failure, the setting-up procedure already described need not be repeated, instead knob 220 need simply be moved upwardly so that the three tapes may be simultaneously set to an appropriate date.

While a preferred embodiment of the present invention has been described, it should be understood that various changes, adaptations and modifications may be made therein without departing from the spirit of the invention and the scope of the appended claims.

What is claimed is:

1. A biorhythm calculating and display device comprising;

a first endless belt marked with a sinusoidal pattern for indicating a physical biorhythm function;

a second endless belt marked with a sinusoidal pattern for indicating the emotional biorhythm function;

a third endless belt marked with a sinusoidal pattern for indicating the intellectual biorhythm function;

said first, second and third belts comprising thereof overlying one another throughout a substantial portion of the length of each belt to thereby provide a composite biorhythm display image;

a viewing area in which said composite biorhythm image is visibly disposed;

means for illuminating said viewing area;

first spool means for suspending and rotating said first belt;

second spool means for suspending and rotating said second belt;

third spool means for suspending and rotating said third belt;

spring biased means for tensioning each of said first, second and third belts;

motor means for powering the calculating and display device;

first manually adjustable gear means operable in a first position to couple said first spool means to said motor means and operable in a second position to disengage said first spool means from said motor means and to synchronize said first belt with the physical biorhythm function of an individual;

second manually adjustable gear means operable in a first position to couple said second spool means to said motor means and operable in a second position to disengage said second spool means from said motor means and to synchronize said second belt with the emotional biorhythm function of an individual; and, third manually adjustable gear means operable in a first position to couple said third spool means to said motor means and operable in a second position to disengage said third spool means from said motor means and to synchronize said third belt with the intellectual biorhythm function of an individual.

2. The combination as defined in claim 1 including gear linkage means normally operatively coupled between said motor means and said first, second and third manually adjustable gear means, said gear linkage means operable in a second position disengaged from said motor means to manually, simultaneously adjust the position of said first, second and third belts.

3. Apparatus for graphically displaying the personal biorhythm of an individual commencing on a date that operation of said apparatus is desired, said apparatus comprising:

first substantially transluscent endless belt means marked with a sinusoidal waveform for indicating the physical biorhythm function of said individual;

second substantially transluscent endless belt means marked with a sinusoidal waveform for indicating the emotional biorhythm function of said individual;

third substantially transluscent endless belt means marked with a sinusoidal waveform for indicating the intellectual biorhythm function of said individual;

said first, second and third belt means substantially overlying one another throughout a substantial portion of the length of each belt means to thereby provide a composite biorhythm display image;

first spool means for supporting and suspending said first belt means, said first spool means including first drive spool means for rotating said first belt means;

second spool means for supporting and suspending said second belt means, said second spool means including second drive spool means for rotating said second belt means;

third spool means for supporting and suspending said third belt means, said third spool means including third drive spool means for rotating said third belt means;

motor means for powering said apparatus;

first gear means for coupling said first drive spool means to said motor means, said first gear means manually adjustable to a position disengaged from said motor means to synchronize said first belt means with the physical biorhythm of said individual;

second gear means for coupling said second drive spool means to said motor means, said second gear means manually adjustable to a position disengaged from said motor means to synchronize said second belt means with the emotional biorhythm of said individual;

third gear means for coupling said third drive spool means to said motor means, said third gear means manually adjustable to a position disengaged from said motor means to synchronize said third belt means with the intellectual biorhythm of said individual; and, intermediate gear means for normally coupling said motor means to said first, second, and third gear means, said intermediate gear means manually disengageable from said motor means to simultaneously adjust the position of said first, second and third belt means to synchronize said biorhythm display apparatus with a date that operation of it is desired.

4. The combination as defined in claim 3 including spring biased means for tensioning each of said first, second and third belt means.

* * * * *